US008801395B2

(12) United States Patent
Heimonen

(10) Patent No.: US 8,801,395 B2
(45) Date of Patent: Aug. 12, 2014

(54) STARTUP BYPASS SYSTEM FOR A SCREW COMPRESSOR

(75) Inventor: Timothy Keene Heimonen, LaGrange, MO (US)

(73) Assignee: Gardner Denver, Inc., Quincy, IL (US)

( * ) Notice: Subject to any disclaimer, the term of this patent is extended or adjusted under 35 U.S.C. 154(b) by 801 days.

(21) Appl. No.: 12/139,820

(22) Filed: Jun. 16, 2008

(65) Prior Publication Data

US 2009/0308471 A1 Dec. 17, 2009

(51) Int. Cl.

| | |
|---|---|
| ***F04C 18/16*** | (2006.01) |
| ***F04C 28/06*** | (2006.01) |
| ***F04C 28/16*** | (2006.01) |
| ***F04C 28/26*** | (2006.01) |
| ***F04C 28/12*** | (2006.01) |
| *F04C 29/12* | (2006.01) |

(52) U.S. Cl.

CPC ..... *F04C 18/16* (2013.01); *F04C 28/16* (2013.01); *F04C 29/126* (2013.01); *F04C 28/26* (2013.01); *F04C 28/06* (2013.01); *F04C 28/12* (2013.01)

USPC ..... 417/310; 417/53; 417/307; 417/410.4

(58) Field of Classification Search

USPC ..... 417/301, 304, 307, 309, 310, 410.4, 53

See application file for complete search history.

(56) References Cited

U.S. PATENT DOCUMENTS

| | | | | |
|---|---|---|---|---|
| 1,409,868 | A | 3/1922 | Kien | |
| 1,459,552 | A | 6/1923 | Rathman | |
| 3,084,851 | A | 4/1963 | Schibbye et al. | |
| 3,178,104 | A | 4/1965 | Williams et al. | |
| 3,677,664 | A | 7/1972 | Wycliffe et al. | |
| 4,042,310 | A * | 8/1977 | Schibbye et al. | 417/310 |
| 4,498,849 | A * | 2/1985 | Schibbye et al. | 417/299 |
| 5,108,269 | A * | 4/1992 | Glanvall | 417/310 |
| 5,341,658 | A * | 8/1994 | Roach et al. | 62/468 |
| 5,860,801 | A * | 1/1999 | Timuska | 418/9 |
| 5,979,168 | A * | 11/1999 | Beekman | 62/228.5 |
| 6,530,753 | B2 * | 3/2003 | Aramaki | 417/310 |
| 1,023,360 | A1 | 4/2012 | Brauer | |
| 1,026,120 | A1 | 5/2012 | Peterson | |
| 2004/0247465 | A1 * | 12/2004 | Yoshimura | 417/410.4 |
| 2008/0206085 | A1 * | 8/2008 | Zieglgansberger | 418/85 |
| 2010/0028165 | A1 * | 2/2010 | Kameya et al. | 417/12 |

FOREIGN PATENT DOCUMENTS

| | | | | |
|---|---|---|---|---|
| WO | WO2007009669 A2 * | 1/2007 | | F04C 29/04 |

* cited by examiner

*Primary Examiner* — Peter J Bertheaud

(74) *Attorney, Agent, or Firm* — James B. Conte; Husch Blackwell LLP

(57) ABSTRACT

A twin screw compressor has a working chamber bypass that is used at start-up of the compressor. This system provides pressure relief by allowing oil or other fluid to pass through it. The bypass includes a fluid passage that extends from the working chamber to the discharge port with a one way valve disposed inside the passage.

7 Claims, 8 Drawing Sheets

STARTUP BYPASS SYSTEM FOR A SCREW COMPRESSOR

FIELD OF DISCLOSURE

The present disclosure relates to machines flooded with incompressible and compressible fluids such as pumps. More specifically, this disclosure relates to start-up assist systems for pumps such as screw compressors and vacuum pumps.

BACKGROUND ART

Conventional oil flooded twin screw rotary compressors have an oil reservoir positioned below the compression chamber. The relative position of the oil reservoir allows oil to drain from the compression chamber when the compressor is not in operation.

SUMMARY OF DISCLOSURE

The present disclosure provides a working chamber bypass or fluid passage configuration for machines such as pumps, for instance, an oil flooded twin screw compressor. The bypass has a fluid passage that extends from the working chamber of the pump. Inside the passage is a one way valve. This bypass provides a means of escape for oil and for other fluids in the compressor working chamber during start-up. Allowing fluids to escape reduces the amount of motor torque required to start the compressor, and in the case of oil flooded screw compressors, can eliminate or reduce the need to drain the oil at shut down.

Accordingly, one embodiment of the invention provides an air end housing of a compressor. The air end housing has an inlet port, a discharge port and a working chamber. The inlet port leads into the working chamber and the discharge port leads out of the working chamber.

The air end housing includes, as an integral portion or as a separate component, a fluid passage configuration or working chamber bypass. The bypass has a fluid passage inlet, a fluid passage outlet, a fluid channel and a fluid flow control member in said channel. The fluid passage inlet provides an opening into the fluid channel from the working chamber. The fluid passage outlet provides a fluid exit from the fluid channel. The flow control member permits fluid to only flow in a direction leading from the working chamber, into the fluid channel, and out the fluid passage outlet. The control member prevents any and all of the fluid exiting from the working chamber from flowing back into the chamber through the fluid passage inlet.

When the air end housing is assembled as a component of a pump, and the pump is in a start-up mode, an amount of fluid will flow out of the working chamber into the fluid passage inlet, through the control member, out the fluid passage outlet and into the discharge port. When the pump is in the running mode, fluid will flow through the working chamber and generally not enter the bypass.

Whether fluid flows through the bypass is a function of the differential pressure across the fluid flow control member. When the pump has a small amount of oil relative to the large amount of compressible air, and the pump is at operating pressure, i.e., in the running mode, the pressure at the discharge port and fluid passage outlet will be substantially higher than the pressure at the fluid inlet. During the start up mode, i.e., before the pump has reached operating pressure, the working chamber has a large amount of oil and only a small amount of air; thus the reverse is true.

In at least one embodiment of the invention, the flow control member is a one-way valve. The valve is disposed in the fluid channel.

In an alternative embodiment, there can be a plurality of fluid passage inlets opening into the fluid channel. Also there can be a plurality of fluid channels and fluid passage inlets, and/or a plurality of fluid passage configurations. In at least one embodiment, the fluid passage inlet opens into the working chamber in a low pressure zone of the working chamber.

Although the detailed disclosure describes a twin screw oil flooded compressor, it is understood that the disclosure is applicable to many types of machines that are flooded with a combination of compressible and incompressible fluids such as oil and air.

The following description sets forth specific examples of our invention and is not intended to limit the scope of our invention to the specific embodiments described and shown.

DETAILED DISCLOSURE

Figure 1:
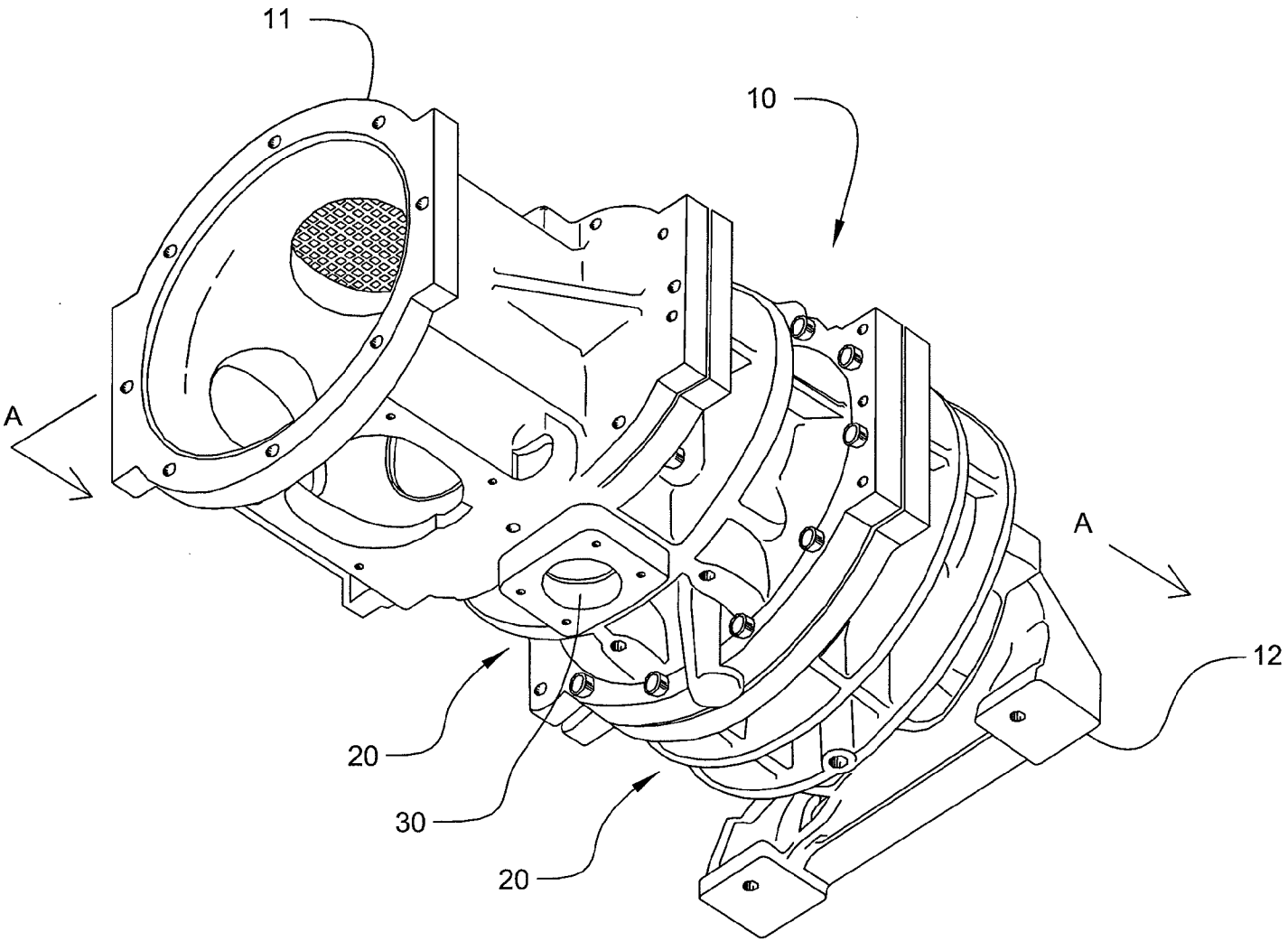
FIG. 1 is a schematic stripped down bottom perspective view of an oil flooded twin screw compressor air end embodying the invention.
Figure 2:
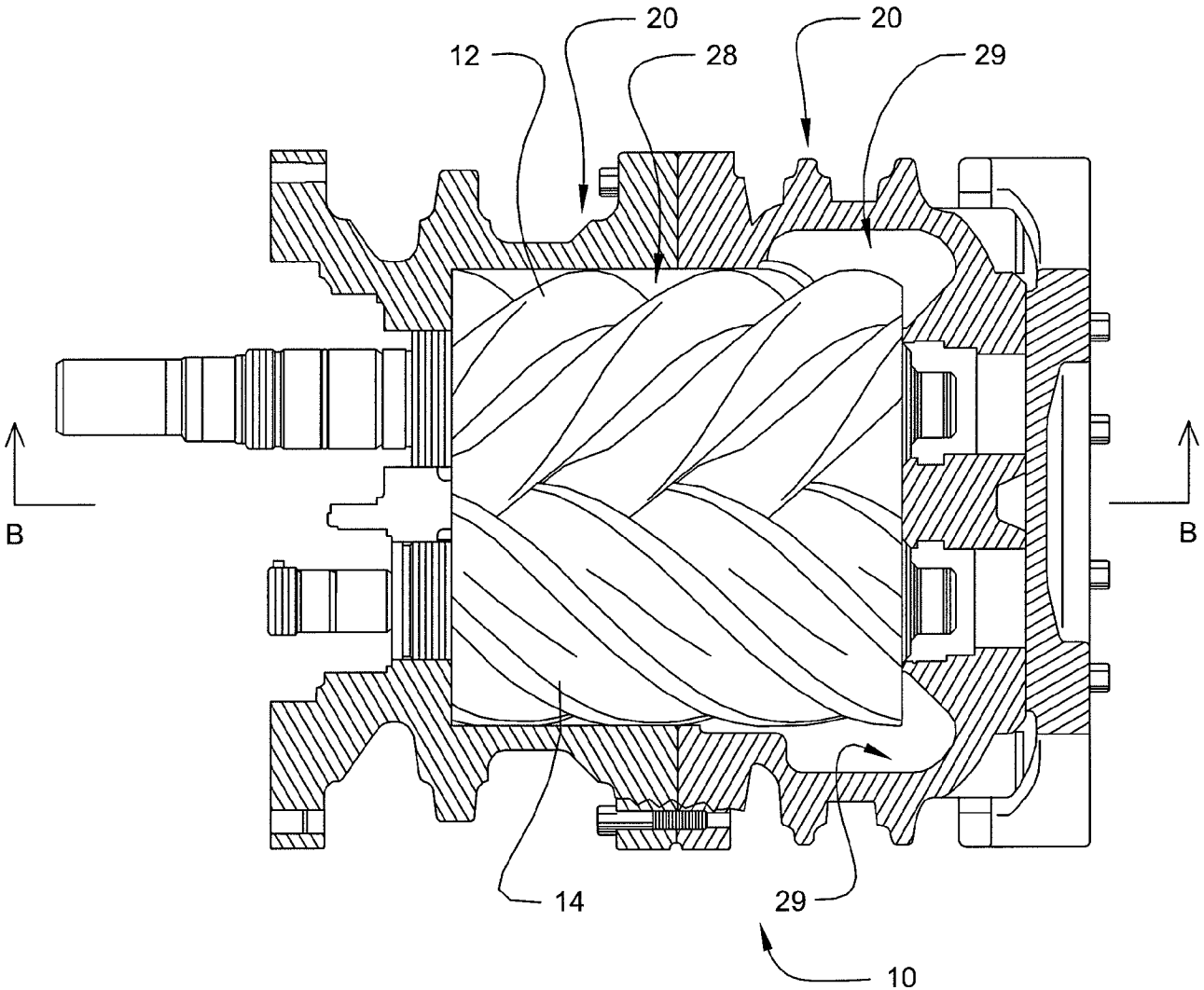
FIG. 2 is a cutaway view along section line A-A of FIG. 1 exclusive of the motor mount and bearing assemblies.

A compressor air end 10 includes a pair of rotors 12, 14, and air end housing 20. The air end housing 20 has a working chamber which in this example is a compression chamber 28. The compression chamber 28 has an air or gas inlet port 29 and a discharge port 30. The air end housing 20 also has a compression chamber fluid bypass or fluid passage configuration 24, 26 to allow fluids in the compression chamber, at start-up, to escape chamber 28 without having to pass through the compression chamber to exit at discharge port 30. The air end 10, is shown in FIGS. 1 and 2, coupled to a motor mount 11 and end cover 12.

Figure 4:
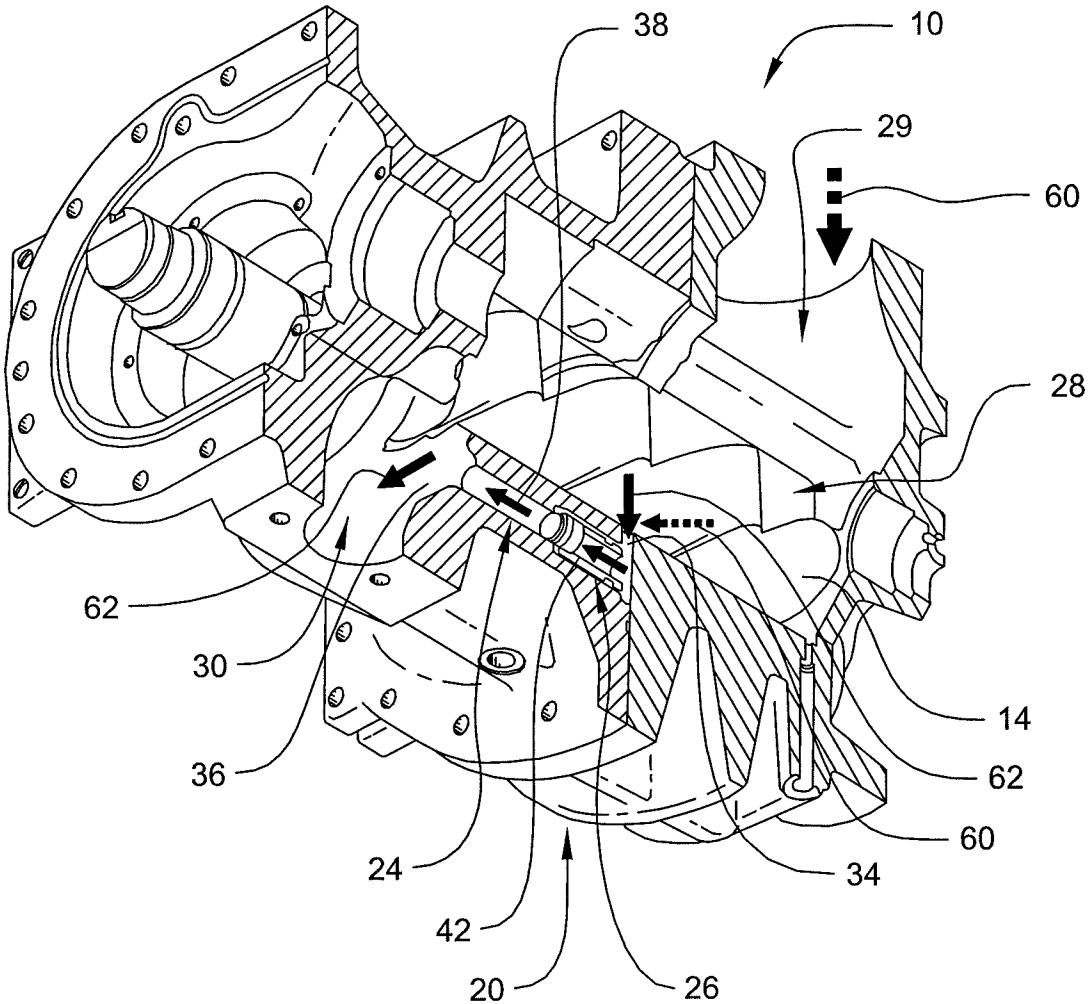
FIG. 4 is a perspective of the sectional view of FIG. 3.
Figure 5:
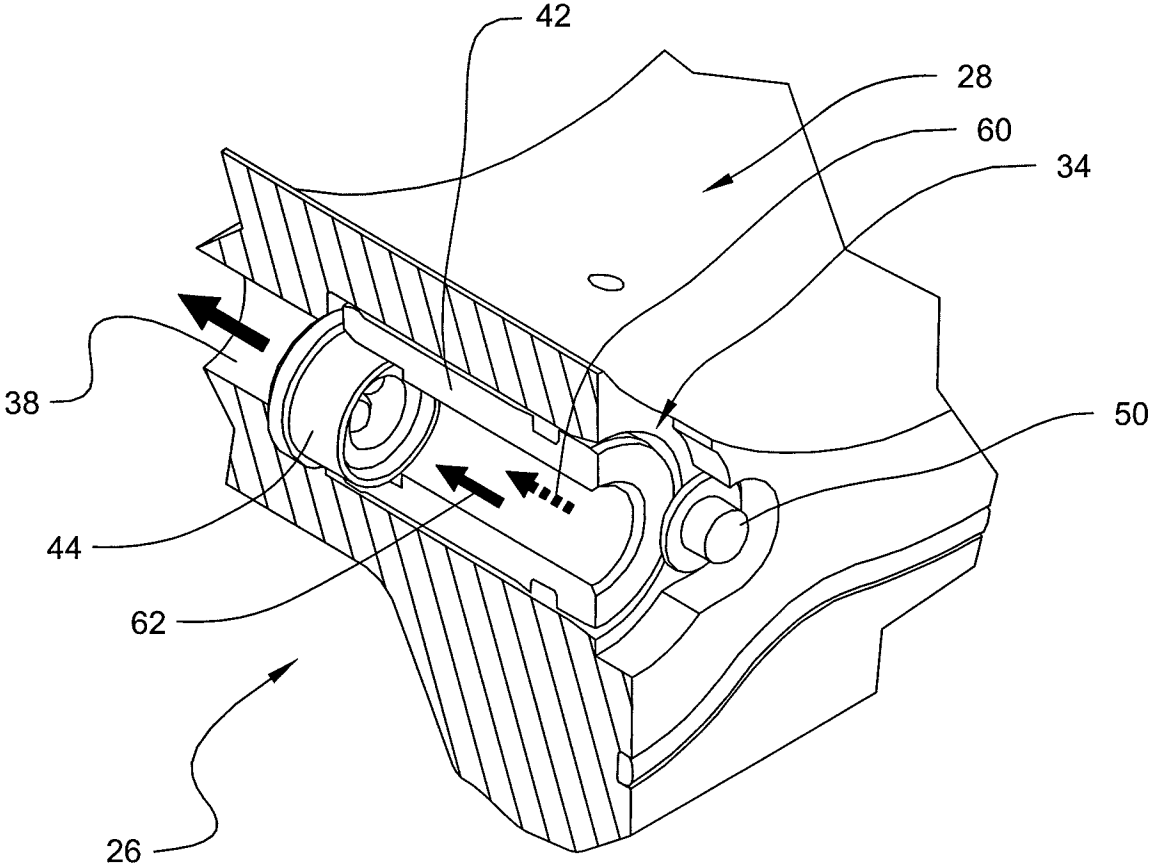
FIG. 5 is an enlarged perspective view of the valve in the passage of FIG. 4.
Figure 6:
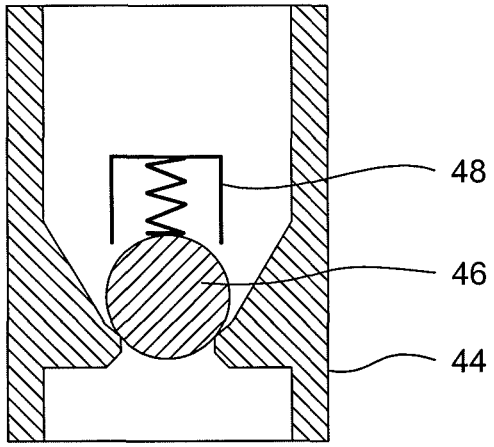
FIG. 6 is a schematic cut away view of a closed ball check valve.

As can be seen in FIGS. 4 and 5, the working chamber bypass or fluid passage configuration 24, 26 is comprised of passage 24 and valve assembly 26. Valve assembly 26 is disposed in passage 24. The channel or passage 24 and valve assembly 26 provide a pathway along which fluid in compression chamber 28 of air end 10 will flow at start-up. The bypass 24, 26 allows a portion of fluid in the compression chamber 28 at start-up, i.e., before operating pressure is reached, to exit the compression chamber 28 through passage 24 as opposed to having to pass through compression chamber 28 and exit at port 30.

In the case of an oil flooded screw compressor, the escape of the oil through fluid bypass 24, 26 reduces the amount of torque required at start-up needed to drive rotors 12, 14 as compared to a compressor having oil in chamber 28 at start-up, wherein the air end does not have a bypass 24, 26. Accordingly, oil can remain in the compression chamber 28 after shut down without causing the deleterious affect of increased torque at start-up. Reducing the deleterious affect of leaving oil in the compression chamber 28 reduces the need for time consuming oil drain operations to shut down the compressor. Also, as the oil reservoir does not have to be used to capture oil drained from the compression chamber, the oil reservoir can be placed in different positions relative to the air end. This allows for a greater variety of set-ups as compared to a compressor using a conventional air end.

Figure 3:
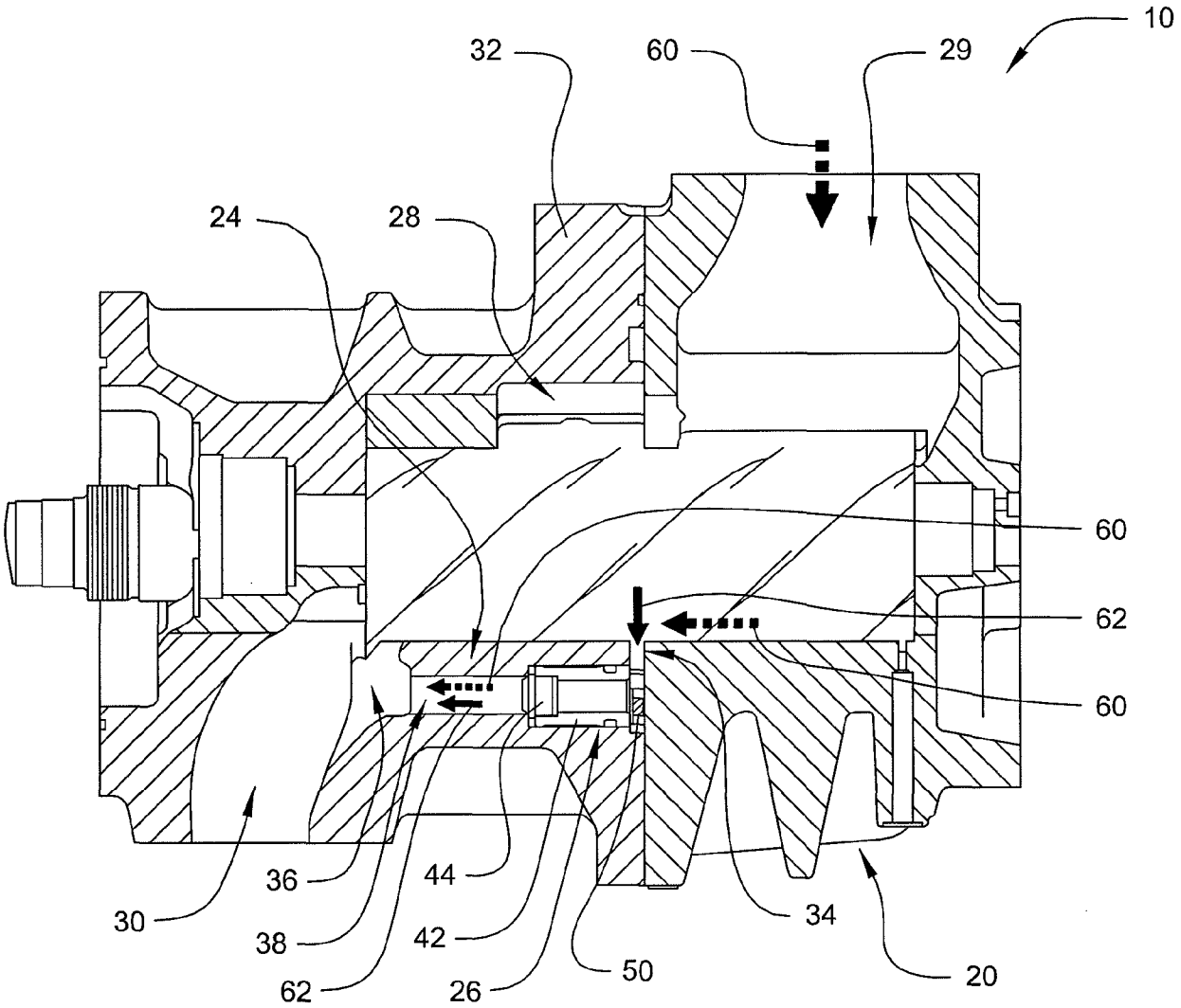
FIG. 3 is an irregular cutaway view, with one rotor removed, along section line B-B of FIG. 2, exclusive of the motor mount, bearing assemblies and end cover.

In more detail, as seen in FIG. 3, the compression chamber bypass 24, 26 lies between the first screw 12 and second screw 14 and at the bottom of the compression chamber 28. As seen in FIGS. 4 and 5, the fluid passage 24 extends a length from the middle of air end housing 20.

The passage 24 includes a fluid passage inlet 34 and a passage outlet 36 with a fluid channel 38 there between. The fluid channel 38 includes a valve chamber 40 which houses valve assembly 26. The passage inlet 34 extends from the compression chamber 28 into the fluid channel 38. The channel 38 opens into the fluid passage outlet or exit 36. The passage outlet or exit 36 opens into the discharge port 30.

Figure 7:
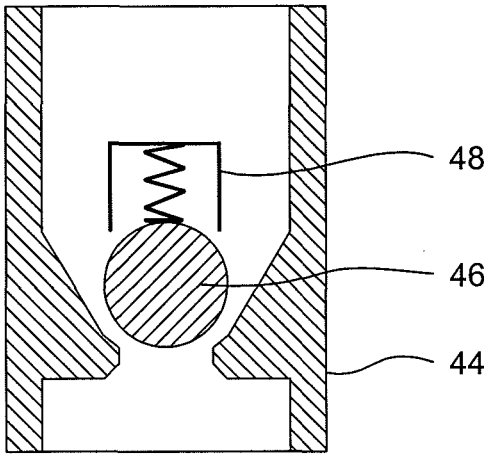
FIG. 7 is a schematic cut away view of an open ball check valve.
Figure 8:
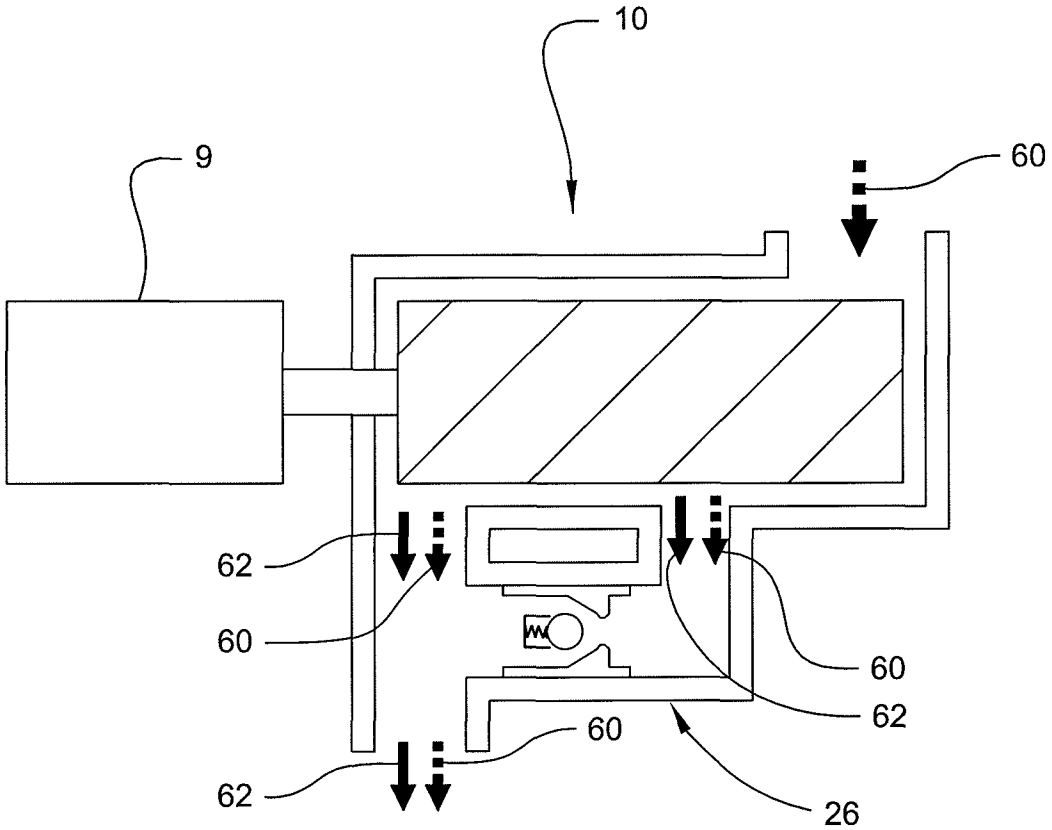
FIG. 8 is a schematic basic depiction of an air end like that of FIG. 1 assembled as a component of an oil flooded air compressor in start-up mode.

The valve assembly 26 includes a valve retainer 42 located in chamber 40. The valve assembly 26 also includes a valve seat 44, ball 46, and spring 48 coupled to the valve retainer 42. Valve retainer 42 is retained in valve chamber 40, in part, by retainers 50 which are screws. Only one screw 50 is shown. The valve seat 44, ball 46 and spring 48 form a simple ball check valve. When the valve assembly 26 is closed, as seen in FIG. 7, the spring 48 biases the ball 46 against the valve seat 44. Once sufficient pressure is placed on ball 46, the ball 46 moves off the valve seat 44 against the bias of the spring 48 and the valve assembly 26 is open, as seen in FIG. 8. Once the pressure is reduced, the valve 26 will again close.

In other embodiments the valve assembly 26 could include a swing check valve, clapper valve, stop-check valve, lift-check valve, double check valve, or other one way valve that will not allow reverse flow and will be open under the desired conditions. In yet another embodiment, the valve 26 could be electronically controlled to open and close at given times or under given conditions. The valve assembly 26 could also be disposed inside other portions of the passage 24. Broadly any flow control member, such as a one way valve, will suffice for the purposes of the invention. The only requirement of the flow control member is that it not unduly inhibit the flow of fluid out the chamber 28 through the passage 24 during start-up of the compressor, and that it will prohibit fluid discharged from the chamber 28 from backing into chamber 28 through the inlet 34.

Figure 3A:
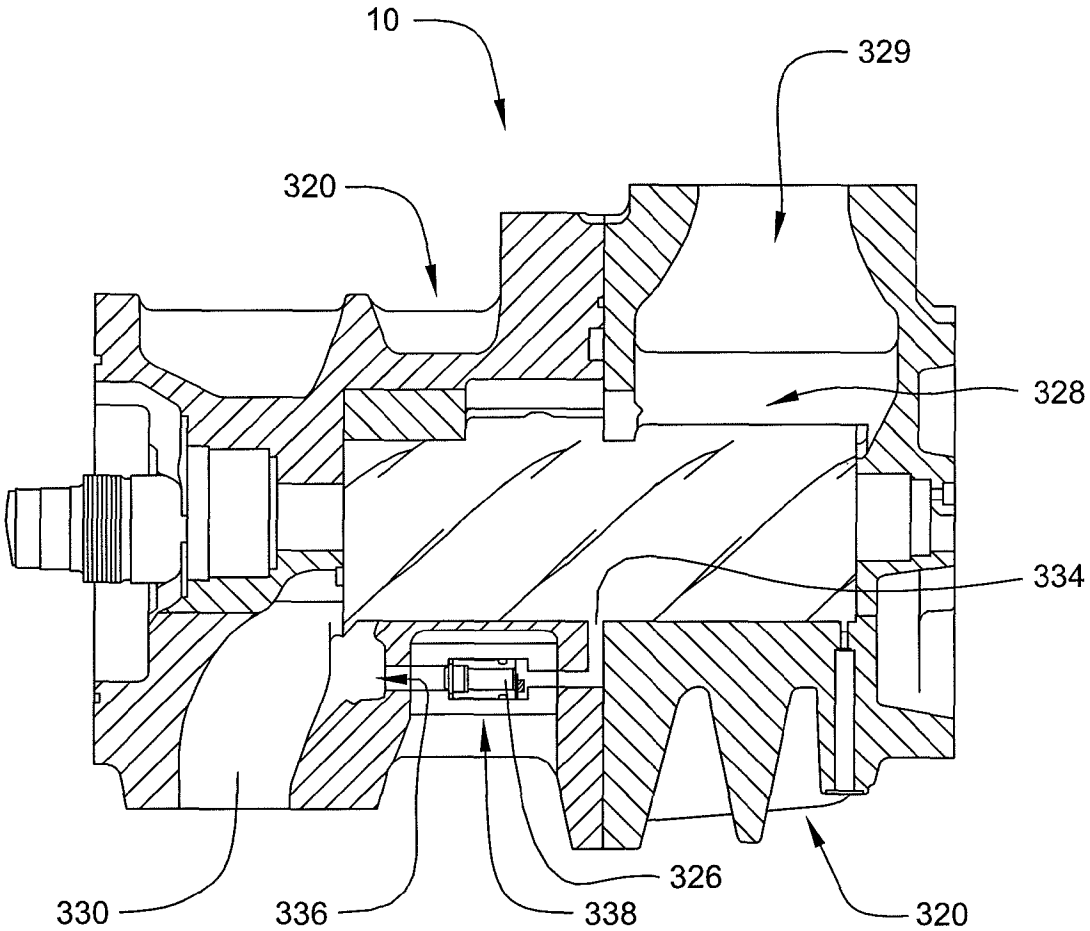
FIG. 3A is a cutaway view similar to FIG. 3 wherein a portion of the fluid passage bypass is formed in an external conduit.

In other embodiments, the channel 24 could extend the full length of the compression chamber 28. In yet other embodiments, multiple passage inlets 34 and/or valve assemblies 26 could be placed along the length of the compression chamber 28. In yet another embodiment, multiple bypasses 24, 26 could be employed throughout the length of the compression chamber 28. In alternative embodiments, multiple bypasses 24, 26 could be located at the lowest point of one or both the first screw 12 and second screw 14 and not between them. Further, although FIG. 3 shows fluid passage 24 as an internal hollow within housing 20, passage 24 or a part thereof could be formed by way of an external conduit. See FIG. 3*a*. In this embodiment the fluid channel is shown as conduit 338. The conduit includes valve assembly 326. The outlet 336 is at the open end of conduit 338 and opens into discharge conduit 330. The inlet 334 opens into working chamber 328 of housing 320 of air end 310. The gas enters housing 310 at inlet 329.

Alternative embodiments could also include the passage outlet 36 not opening into the outlet 30 but having another exit. In one such alternative, the passage outlet 36 could exit into a reservoir and oil existing from outlet 36 can be eventually fed back into the compression chamber 28 to recycle the oil.

In operation, a motor 9 turns the first screw 12. The second screw 14 is turned by meshing with the first screw. The first screw 12 turns the second screw 14 in the opposite direction and with a speed ratio proportional to the numbers of lobes on the two screws. The turning of the screws causes air or gas (fluid) 60 to enter the compression chamber 28 through inlet port 29 and exit the chamber through discharge port 30.

As a result of the pressures created by the turning of the screws 12, 14 at start-up, oil 62, in the case of an oil flooded screw compressor, and other fluid (air) in chamber 28 are forced into the passage inlet 34. The fluids pass through valve assembly 26 into fluid channel 38, through the passage outlet 36, and into discharge port 30. Therefore, during the start-up mode or first phase, oil 62 and other fluids, such as air, pass through the valve assembly 26 and channel 24. The pressure at the discharge port 30 and outlet 36 are less than the pressure at inlet 34 during start-up. There will also be some air and oil passing through the working chamber 28 and exiting at the discharge port 30. See FIG. 8.

During operation, after start-up, the compressor enters the running mode. The pressure at the discharge port 30 and passage outlet 36 is very high compared to the pressure at the fluid inlet 34. The difference in pressure on the two sides of the valve assembly 26 in the running mode allows the spring 48 to be able to urge the ball 46 back on valve seat 44 and the check valve to close. The oil 62 and other fluid such as air in the compression chamber are carried through compression chamber 28 into the discharge port 30 without passing through the bypass 24, 26. Thus, fluid flow through the inlet 34 will generally stop all together. The flow control member 26 functions to ensure that oil 62 or air 60 does not back up into chamber 28 due to the elevated pressure in the discharge port 30 compared to the lower pressure at the inlet of the passage 34 during the running mode.

The amount of torque required to get the compressor from start-up to its running mode is reduced when fluids, such as oil or air are allowed to escape through passage 24 as opposed to having to be pushed through chamber 28. The reduction in torque, as measured by a reduction in amps required to power a compressor motor during start-up, was observed during a test of the invention. As part of the test a valve was installed which could be actuated to prevent oil from flowing through a bypass similar to bypass 24, 26. When the valve was activated to prevent oil from escaping from a compressor's compression chamber into the bypass, the motor starting current in amps ramped up to 450 amps after about one second and stayed at that level for a total of 3.2 seconds, after which the amps began to drop. On the other hand, when the oil was allowed to escape into the bypass, the motor starting current ramped up to about 400 amps after one second and began to drop off after a total of about 1.7 seconds. Therefore, with use of the bypass, the peak current only lasted 0.7 seconds. Without the bypass, the peak current lasted 2.2 seconds.

As indicated above, the bypass 24, 26 also operates as a vent to allow the escape of air caught in rotor cavities at start-up. When a compressor is shut down, a level of air pressure remains in the chamber. Some of the air is caught in the rotor cavities, some is just caught in the compression chamber. The caught air at start-up creates a zone of high pressure above the inlet 34. Some of the caught air at start-up will thus escape through inlet 34 as opposed to traveling through chamber 28 to outlet 30. The escape (vent) of air reduces the amount of torque required at start-up. The reduction in torque means a motor which normally operates to drive a compressor having a psi of X in the chamber at start-up, can operate to drive a compressor having a psi greater than X. In a test, it was found that a compressor at start-up without a bypass similar to bypass 24, 26 allowed to operate, could function with up to 70 PSI of pressure in the compression chamber. If more than 70 PSI were in the chamber, the compressor motor would stall. If the bypass were allowed to operate at start-up, the compressor could operate up to 100 PSI before the variable drive motor stalls.

The above makes it clear that the orientation of the fluid passage 24 and in particular the fluid inlet(s) 34 is important. The inlet(s) should be located so it opens into a low pressure zone of the compression chamber. The zone having low pressure when the compressor is in the running mode is a low pressure zone.

Although the above description is directed to twin screw compressors, it is of course, understood that our disclosure is applicable to many types of machines. Indeed, this disclosure can be employed to assist the start-up of many types of machines whose start-up is hampered by high internal pressures. In those cases, the bypass 24, 26 currently described can be adapted to those applications. The claims are to be read inclusively.

The invention claimed is:

1. A method of operating an incompressible fluid flooded pump, said pump having an air end housing, said air end housing having twin screws said air end housing having an air or gas inlet port, discharge port and a working chamber, said inlet port leading into said working chamber and said discharge port leading out of said working chamber, said pump further has a working chamber bypass leading out of said working chamber, said twin screws are disposed in said working chamber, said working chamber bypass comprising a fluid passage inlet, a fluid passage outlet, a fluid channel, and a fluid flow control member, wherein, said fluid passage inlet provides an opening into said fluid channel from said working chamber, and said fluid passage outlet provides a fluid exit from said fluid channel, said method comprising:

carrying incompressible fluid in said incompressible fluid flooded pump from said working chamber into said discharge port during a running mode of said pump;

shutting down said incompressible fluid flooded pump after said pump enters said running mode without draining incompressible fluid from said working chamber;

leaving the not drained incompressible fluid in said working chamber as a left amount of incompressible fluid;

starting up said incompressible fluid flooded pump after shut down with said left amount of incompressible fluid in said working chamber and without draining said working chamber prior to start-up;

allowing an amount of said left amount of incompressible fluid to flow from said working chamber through the working chamber bypass including the fluid passage inlet, the fluid channel, the fluid flow control member and the fluid passage outlet while said pump is in a start-up mode;

making a groove of one of said twin screws adjacent said fluid passage inlet;

prohibiting incompressible fluid which has flowed through the fluid passage inlet and fluid flow control member from flowing back into the working chamber; and prohibiting, generally, the flow of incompressible fluid to go from the working chamber and out the fluid passage outlet during said running mode of said pump.

2. The method of claim 1 wherein said fluid flow control member is a valve.

3. The method of claim 2 wherein said valve is disposed in said fluid channel.

4. The method of claim 1 wherein said working chamber bypass further comprises: a plurality of fluid passage inlets opening into said fluid channel.

5. The method of claim 1 wherein said working chamber bypass further comprises: a plurality of fluid channels and fluid passage inlets.

6. The method of claim 1 further comprising: a plurality of working chamber bypasses.

7. The method of claim 1 wherein said fluid passage inlet opens into said working chamber in a low pressure zone of said working chamber.

* * * * *